US011337277B2

(12) United States Patent
Ranish

(10) Patent No.: US 11,337,277 B2
(45) Date of Patent: May 17, 2022

(54) CIRCULAR LAMP ARRAYS

(71) Applicant: Applied Materials, Inc., Santa Clara, CA (US)

(72) Inventor: Joseph M. Ranish, San Jose, CA (US)

(73) Assignee: Applied Materials, Inc., Santa Clara, CA (US)

( * ) Notice: Subject to any disclaimer, the term of this patent is extended or adjusted under 35 U.S.C. 154(b) by 198 days.

(21) Appl. No.: 16/390,892

(22) Filed: Apr. 22, 2019

(65) Prior Publication Data

US 2020/0022223 A1 Jan. 16, 2020

Related U.S. Application Data

(63) Continuation of application No. 14/462,865, filed on Aug. 19, 2014, now Pat. No. 10,271,382.

(60) Provisional application No. 61/874,552, filed on Sep. 6, 2013.

(51) Int. Cl.
*H05B 3/00* (2006.01)
*H05B 1/02* (2006.01)

(52) U.S. Cl.
CPC ..... *H05B 3/0047* (2013.01); *H05B 1/0233* (2013.01)

(58) Field of Classification Search
CPC ..... H05B 1/0233; H05B 3/0047
USPC ..... 392/428
See application file for complete search history.

(56) References Cited

U.S. PATENT DOCUMENTS 5,444,217 A * 8/1995 Moore ..... C23C 16/4404 219/405
6,805,466 B1 10/2004 Ranish
2003/0094446 A1 5/2003 Tay et al.
2010/0215872 A1* 8/2010 Sivaramakrishnan .. C23C 16/46 427/585

FOREIGN PATENT DOCUMENTS

| | | | |
|---|---|---|---|
| CN | 101925980 | A | 12/2010 |
| JP | S59-208717 | A | 11/1984 |
| JP | 2003-022982 | A | 1/2003 |
| JP | 2003022982 | * | 1/2003 |
| JP | 2009-200401 | A | 9/2009 |
| KR | 10-2005-0114527 | A | 12/2005 |
| TW | 201218301 | A | 5/2012 |

OTHER PUBLICATIONS

Office Action for Korean Application No. 10-2016-7009084 dated Aug. 20, 2020.

(Continued)

*Primary Examiner* — Dana Ross
*Assistant Examiner* — Joseph W Iskra
(74) *Attorney, Agent, or Firm* — Patterson + Sheridan, LLP

(57) ABSTRACT

Embodiments disclosed herein relate to circular lamp arrays for use in a semiconductor processing chamber. Circular lamp arrays utilizing one or more torroidal lamps disposed in a reflective trough and arranged in a concentric circular pattern may provide for improved rapid thermal processing. The reflective troughs, which may house the torroidal lamps, may be disposed at various angles relative to a surface of a substrate being processed.

20 Claims, 9 Drawing Sheets

(56) References Cited

OTHER PUBLICATIONS

International Search Report and Written Opinion for International Application No. PCT/US2014/051329 dated Nov. 25, 2014.
Search Report for Taiwan Application No. 103130830 dated Feb. 9, 2018.
Search Report for Chinese Application No. 201480046547.3 dated Jan. 8, 2018.
Office Action for Taiwan Application No. 103130830 dated May 29, 2018.
Office Action for Korean Application No. 10-2021-7006975 dated Jan. 20, 2022.

* cited by examiner

CIRCULAR LAMP ARRAYS

CROSS-REFERENCE TO RELATED APPLICATIONS

This application is a continuation application of U.S. patent application Ser. No. 14/462,865, filed Aug. 19, 2014, which claims benefit of U.S. provisional patent application No. 61/874,552, filed Sep. 6, 2013, the entirety of which is herein incorporated by reference.

FIELD

An apparatus for semiconductor processing is disclosed herein. More specifically, embodiments disclosed herein relate to circular lamp arrays for use in a semiconductor processing chamber.

BACKGROUND

Epitaxy is a process that is used extensively in semiconductor processing to form very thin material layers on semiconductor substrates. These layers frequently define some of the smallest features of a semiconductor device. The epitaxial material layers may also have a high quality crystal structure if the electrical properties of crystalline materials are desired. A deposition precursor is normally provided to a processing chamber in which a substrate is disposed and the substrate is heated to a temperature that favors growth of a material layer having desired properties.

It is generally desired that the thin material layers (film/s) have very uniform thickness, composition, and structure. Because of variations in local substrate temperature, gas flows, and precursor concentrations, it is quite challenging to form films having uniform and repeatable properties. The processing chamber is normally a vessel capable of maintaining high vacuum, typically below 10 Torr. Heat is normally provided by heat lamps positioned outside the vessel to avoid introducing contaminants into the processing chamber. Pyrometers or other temperature metrology devices may be provided to measure the temperature of the substrate.

Control of substrate temperature, and therefore local layer formation conditions, is complicated by thermal absorptions and emissions of chamber components and exposure of sensors and chamber surfaces to film forming conditions inside the processing chamber. In addition, providing substantially equal amounts of radiation across the substrate surface is another challenge when attempting to form thin material layers having a low thickness variation (a high degree of uniformity) across the surface of the substrate.

Therefore, there is a need in the art for a radiation system and lamphead array having improved radiation uniformity control and thermal processing capabilities.

SUMMARY

In one embodiment, a lamphead apparatus is provided. The lamphead apparatus includes a body having a bottom surface defining a plane. A reflective trough may be formed in the body and a focal axis of the trough may be angled relative to an axis normal to the plane defined by the bottom surface.

In another embodiment, a lamphead apparatus is provided. The lamphead apparatus may includes a body having a bottom surface defining a plane and a first reflective trough formed in the body. The first reflective trough may have a focal axis positioned at a first angle relative to an axis normal to the plane defined by the bottom surface. A second reflective trough may be formed in the body surrounding the first reflective trough. The second reflective trough may have a focal axis positioned at a second angle relative to an axis normal to the plane defined by the bottom surface different than the first angle.

In yet another embodiment, a lamphead apparatus is provided. The lamphead apparatus includes a body having a bottom surface defining a plane and a first reflective trough formed in the body. The first reflective trough may have a focal axis positioned at a first angle relative to an axis normal to the plane defined by the bottom surface. A second reflective trough may be formed in the body surrounding the first reflective trough. The second reflective trough may have a focal axis positioned at a second angle relative to an axis normal to the plane defined by the bottom surface different than the first angle. A third reflective trough may be formed in the body surrounding the second trough. The third reflective trough may have a focal axis positioned at a third angle relative to an axis normal to the plane defined by the bottom surface different than the first angle and the second angle.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

To facilitate understanding, identical reference numerals have been used, where possible, to designate identical elements that are common to the figures. It is contemplated that elements disclosed in one embodiment may be beneficially utilized on other embodiments without specific recitation.

DETAILED DESCRIPTION

A chamber capable of zoned temperature control of a substrate while performing an epitaxy process has a processing vessel with an upper portion, a side portion, and a lower portion all made of a material having the capability to maintain its shape when high vacuum is established within the vessel. At least the lower portion is substantially transparent to thermal radiation, and thermal lamps may be positioned in a flat or conical lamphead structure coupled to the lower portion of the processing vessel on the outside thereof.

Figure 1:
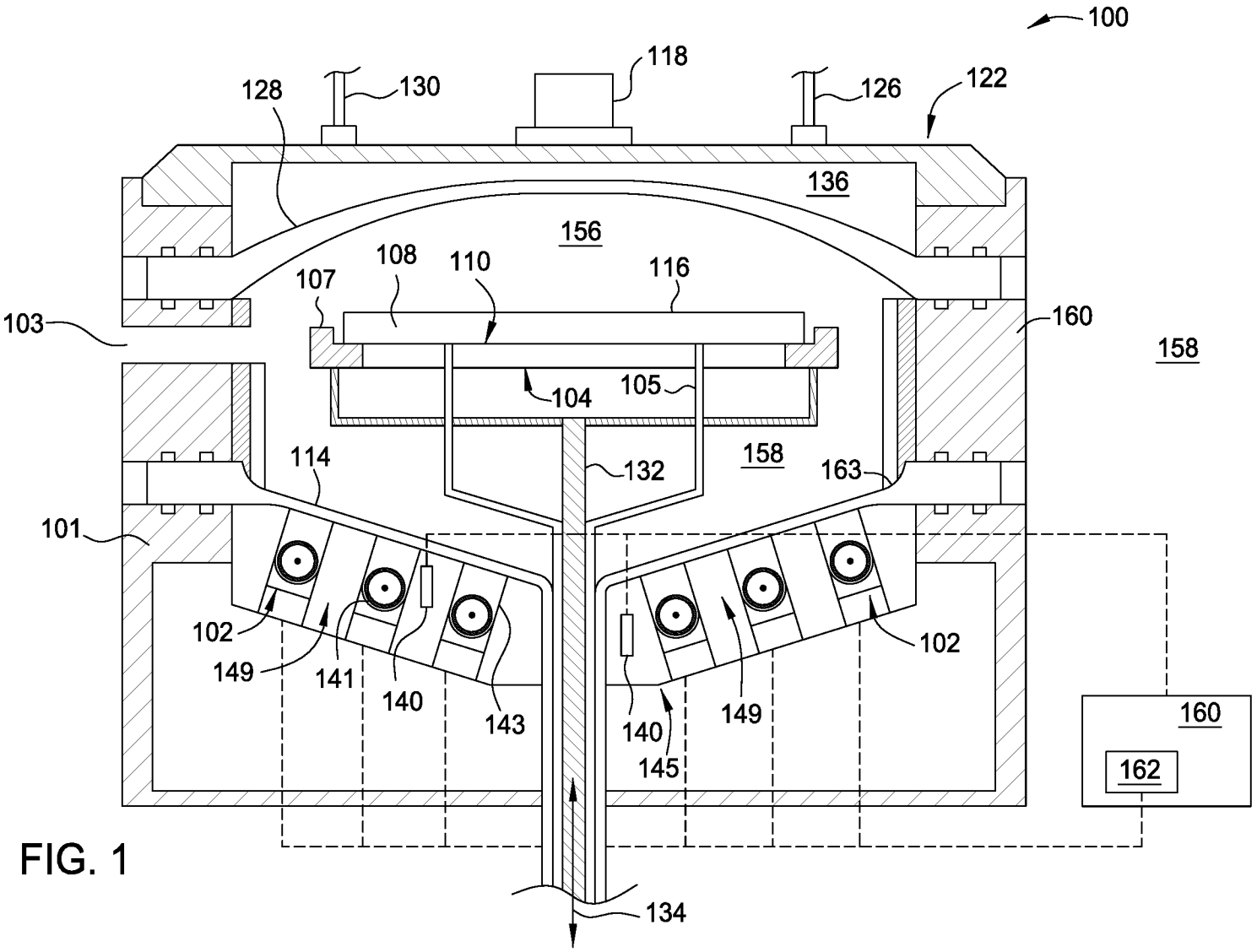
FIG. 1 is a schematic, cross-sectional view of a process chamber according to one embodiment.

FIG. 1 is a schematic cross-sectional view of a process chamber 100 according to one embodiment. The process chamber 100 may be used to process one or more substrates, including the deposition of a material on a device side 116, or upper surface, of a substrate 108. The process chamber 100 generally includes a chamber body 101 and an array of radiant heating lamps 102 for heating, among other components, a ring member 104 of a substrate support 107 disposed within the process chamber 100. The substrate support 107 may be a ring-like substrate support as shown, which supports the substrate 108 from the edge of the substrate 108, a disk-like or platter-like substrate support, or a plurality of pins, for example, three pins or five pins. The substrate support 107 may be located within the process chamber 100 between an upper dome 128 and a lower dome 114. The substrate 108 may be brought into the process chamber 100 and positioned onto the substrate support 107 through a loading port 103.

The substrate support 107 is shown in an elevated processing position, but may be vertically positioned by an actuator (not shown) to a loading position below the processing position to allow lift pins 105 to contact the lower dome 114. The lift pins 105 pass through holes in the substrate support 107 and raise the substrate 108 from the substrate support 107. A robot (not shown) may then enter the process chamber 100 to engage and remove the substrate 108 therefrom though the loading port 103. The substrate support 107 then may be moved up to the processing position to place the substrate 108, with its device side 116 facing up, on a front side 110 of the substrate support 107.

The substrate support 107, while located in the processing position, defines the internal volume of the process chamber 100 into a process gas region 156 (above the substrate 108) and a purge gas region 158 (below the substrate support 107). The substrate support 107 may be rotated during processing by a central shaft 132 to minimize the effect of thermal and process gas flow spatial non-uniformities within the process chamber 100 and thus facilitate uniform processing of the substrate 108. The substrate support 107 is supported by the central shaft 132, which moves the substrate 108 in an axial direction 134 during loading and unloading, and in some instances, during processing of the substrate 108. The substrate support 107 is typically formed from a material having low thermal mass or low heat capacity, so that energy absorbed and emitted by the substrate support 107 is minimized. The substrate support 107 may be formed from silicon carbide or graphite coated with silicon carbide to absorb radiant energy from the lamps 102 and conduct the radiant energy to the substrate 108. The substrate support 107 is shown in FIG. 1 as a ring with a central opening to facilitate exposure of the substrate to the thermal radiation from the lamps 102. The substrate support 107 may also be a platter-like member with no central opening.

The upper dome 128 and the lower dome 114 are typically formed from an optically transparent material, such as quartz. The upper dome 128 and the lower dome 114 may be thin to minimize thermal memory, typically having a thickness between about 3 mm and about 10 mm, for example about 4 mm. The upper dome 128 may be thermally controlled by introducing a thermal control fluid, such as a cooling gas, through an inlet portal 126 into a thermal control space 136, and withdrawing the thermal control fluid through an exit portal 130. In some embodiments, a cooling fluid circulating through the thermal control space 136 may reduce deposition on an inner surface of the upper dome 128.

One or more lamps, such as the array of lamps 102, may be disposed adjacent to and beneath the lower dome 114 in a desired manner around the central shaft 132 to heat the substrate 108 as the process gas passes over the substrate 108, thereby facilitating the deposition of a material onto the upper surface 116 of the substrate 108. In various examples, the material deposited onto the substrate 108 may be a group III, group IV, and/or group V material, or may be a material including a group III, group IV, and/or group V dopant. For example, the deposited material may include gallium arsenide, gallium nitride, or aluminum gallium nitride.

The lamps 102 may be adapted to heat the substrate 108 to a temperature within a range of about 200 degrees Celsius to about 1200 degrees Celsius, such as about 300 degrees Celsius to about 950 degrees Celsius. The lamps 102 may include bulbs 141 surrounded by a reflective trough 143. Each lamp 102 may be coupled to a power distribution board (not shown) through which power is supplied to each lamp 102. The lamps 102 are positioned within a lamphead 145 which may be cooled during or after processing by, for example, a cooling fluid introduced into channels 149 located between the lamps 102. The lamphead 145 conductively cools the lower dome 104 due in part to the close proximity of the lamphead 145 to the lower dome 104. The lamphead 145 may also cool the lamp walls and walls of the reflective troughs 143. If desired, the lamphead 145 may be in contact with the lower dome 114.

An optical pyrometer 118 may be disposed at a region above the upper dome 128. This temperature measurement by the optical pyrometer 118 may also be done on substrate device side 116 having an unknown emissivity since heating the substrate support front side 110 in this manner is emissivity independent. As a result, the optical pyrometer 118 senses radiation from the hot substrate 108 that conducts from the substrate support 107 or radiates from the lamps 102, with minimal background radiation from the lamps 102 directly reaching the optical pyrometer 118. In certain embodiments, multiple pyrometers may be used and may be disposed at various locations above the upper dome 128.

A reflector 122 may be optionally placed outside the upper dome 128 to reflect infrared light that is radiating from the substrate 108 or transmitted by the substrate 108 back onto the substrate 108. Due to the reflected infrared light, the efficiency of the heating will be improved by containing heat that could otherwise escape the process chamber 100. The reflector 122 can be made of a metal such as aluminum or stainless steel. The reflector 122 can have machined channels 126 to carry a flow of a fluid such as water for cooling the reflector 122. If desired, the efficiency of the reflection can be improved by coating a reflector area with a highly reflective coating, such as a gold coating.

A plurality of thermal radiation sensors 140, which may be pyrometers or light pipes, such as sapphire light pipes or sapphire light pipes coupled to pyrometers, may be disposed in the lamphead 145 for measuring thermal emissions of the substrate 108. The sensors 140 are typically disposed at different locations in the lamphead 145 to facilitate viewing different locations of the substrate 108 during processing. In embodiments using light pipes, the sensors 140 may be disposed on a portion of the chamber body 101 below the lamphead 145. Sensing thermal radiation from different locations of the substrate 108 facilitates comparing the thermal energy content, for example the temperature, at different locations of the substrate 108 to determine whether temperature anomalies or non-uniformities are present. Such non-uniformities can result in non-uniformities in film formation, such as thickness and composition. At least two sensors 140 are used, but more than two may be used. Different embodiments may use three, four, five, six, seven, or more sensors 140.

Each sensor 140 views a zone of the substrate 108 and senses the thermal state of a zone of the substrate. The zones may be oriented radially in some embodiments. For example, in embodiments where the substrate 108 is rotated, the sensors 140 may view, or define, a central zone in a central portion of the substrate 108 having a center substantially the same as the center of the substrate 108, with one or more zones surrounding the central zone and concentric therewith. It is not required that the zones be concentric and radially oriented, however. In some embodiments, zones may be arranged at different locations of the substrate 108 in non-radial fashion.

The sensors 140 are typically disposed between the lamps 102 and may be oriented substantially normal to the substrate 108. In some embodiments, the sensors 140 may be oriented normal to the substrate 108, while in other embodiments, the sensors 140 may be oriented in slight departure from normality. An orientation angle within about 5° of normal is most frequently used.

The sensors 140 may be attuned to the same wavelength or spectrum, or to different wavelengths or spectra. For example, substrates used in the chamber 100 may be compositionally homogeneous, or they may have domains of different compositions. Using sensors 140 attuned to different wavelengths may allow monitoring of substrate domains having different composition and different emission responses to thermal energy. Typically, the sensors 140 are attuned to infrared wavelengths, for example about 3 μm.

A controller 160 receives data from the sensors 140 and separately adjusts power delivered to each lamp 102, or individual groups of lamps or lamp zones, based on the data. The controller 160 may include a power supply 162 that independently powers the various lamps or lamp zones. The controller 160 can be configured with a desired temperature profile, and based on comparing the data received from the sensors 140, the controller 160 adjusts power to lamps and/or lamp zones to conform the observed thermal data to the desired temperature profile. The controller 160 may also adjust power to the lamps and/or lamp zones to conform the thermal treatment of one substrate to the thermal treatment of another substrate, in the event chamber performance drifts over time.

Figure 2A:
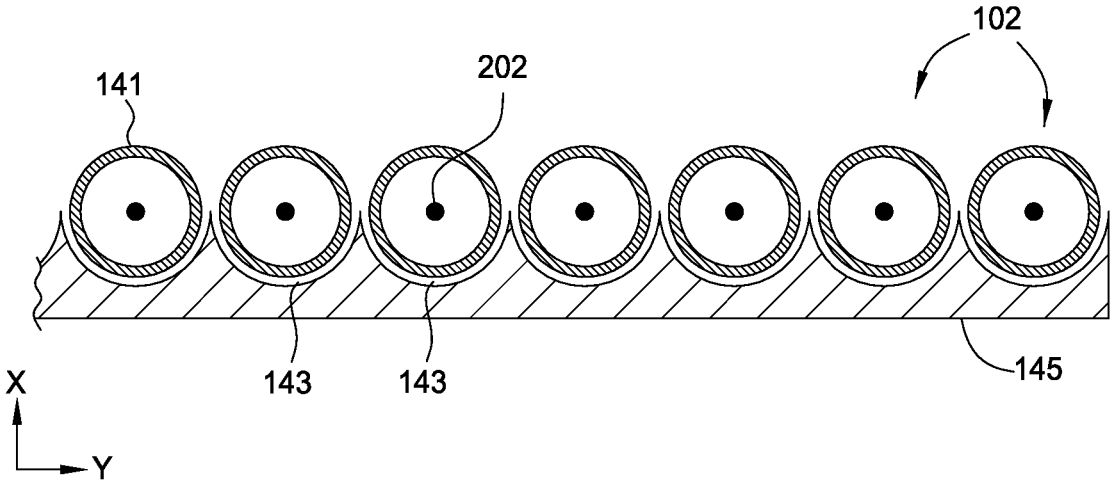
FIG. 2A is a schematic, cross-sectional view of a portion of a lamphead according to one embodiment.

FIG. 2A is a schematic, cross-sectional view of a portion of the lamphead 145. The lamphead 145 body may comprise one or more reflective troughs 143 formed therein from a material suitable for rapid thermal processing, such as stainless steel, aluminum, or ceramic materials. The reflective troughs 143 may be coated with a highly reflective material, such as gold, or may be polished or processed to produce a reflective surface capable of reflecting radiation from the lamps 102 towards a substrate. The reflective troughs 143 may be sized to accommodate the lamps 102 having a torroidal bulb 141 with a filament 202 disposed therein. The lamps 102 will be discussed in greater detail with regard to FIG. 3A-3C. The lamphead 145 may have one or more reflective troughs 143 disposed therein, such as 3 or more troughs, for example, between 7 and 13 troughs. As depicted in FIG. 2A, only one half the lamphead 145 is shown. In this embodiment, 7 reflective troughs 143 are arranged in a concentric circular pattern. Although depicted as forming a semi-circular shaped cross-sectional trough, the reflective troughs 143 may comprise other dimensions, such as a parabolic shape or truncated parabolic shape which will be discuss in greater detail with regard to FIG. 2C.

Figure 2B:
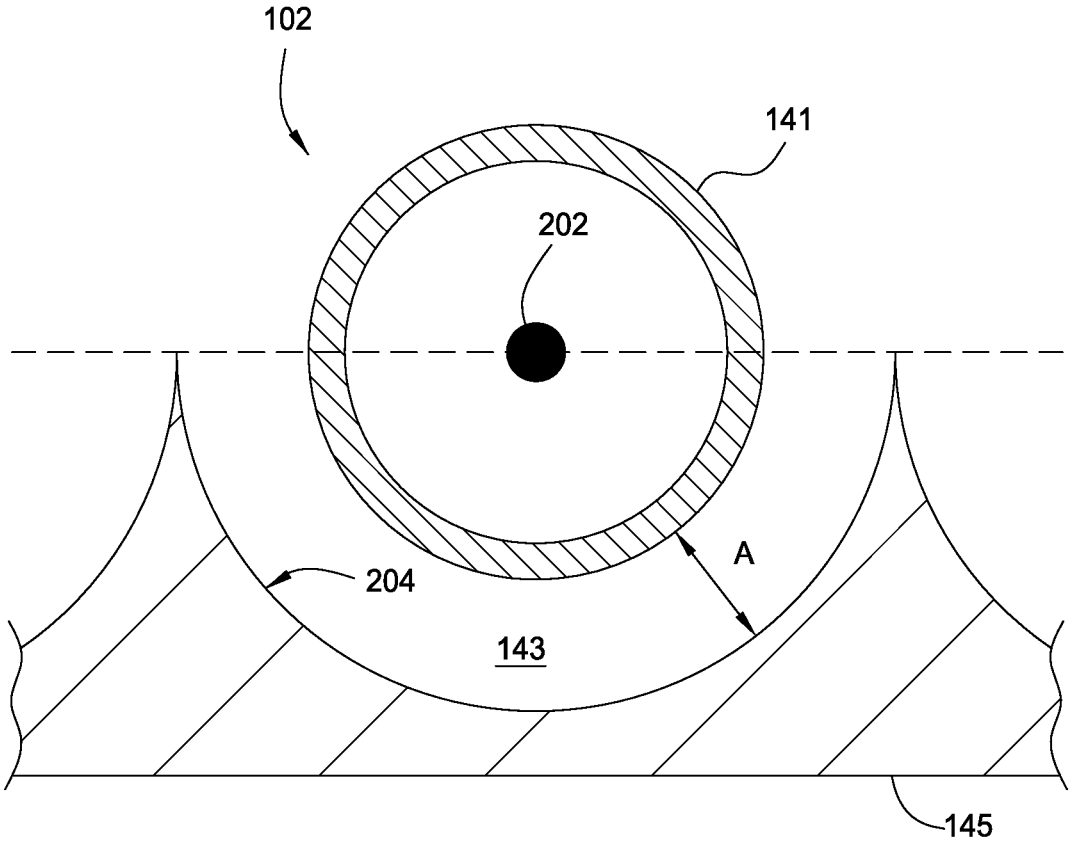
FIG. 2B is a schematic, cross-sectional, close-up view of a lamp disposed in a trough of the lamphead of FIG. 2A according to one embodiment.

FIG. 2B is a schematic, cross-sectional, close-up view of a lamp 102 disposed in a trough of the lamphead 145 of FIG. 2A according to one embodiment. The reflective trough 143 formed in the lamphead 145 may comprise a semi-circular cross-sectional shape. Here, a distance A between a wall 204 of the reflective trough 143 and the bulb 141 may be between about 0.5 mm and about 5.5 mm depending on the number of reflective troughs 143 formed in the lamphead. For example, if thirteen reflective troughs 143 are utilized, the distance A may be between about 0.5 mm and about 1.0 mm, such as about 0.7 mm. If seven or eight reflective troughs 143 are utilized, the distance A may be between about 3.5 mm and about 5.5 mm, such as about 4.5 mm.

The distance A may remain substantially constant between the wall 204 and the bulb 141 at any point within the reflective trough 143. A portion of the lamp 102 may be disposed within the reflective trough 143. As depicted by the horizontal dashed line, approximately one half of the lamp 102 may be disposed within the reflective trough 143 and the remainder of the lamp 102 may remain outside the reflective trough 143. However, it is contemplated that more of less of the lamp 102 may be disposed within the reflective trough 143 to suit radiation requirements as the amount of lamp 102 disposed within the reflective trough 143 may alter the radiation characteristics of the lamp 102. As previously mentioned, the filament 202, or coil, may be disposed within the bulb 141 and will be discussed in greater detail with regard to FIG. 3C.

Figure 2C:
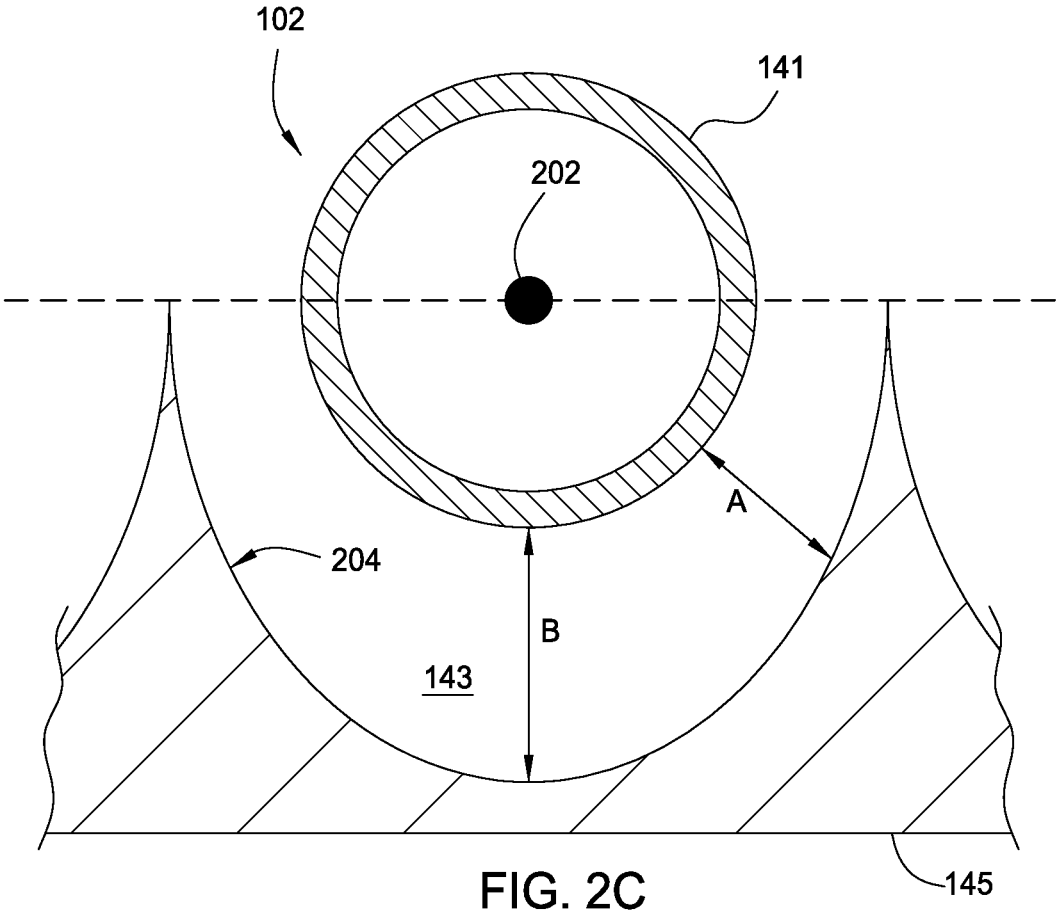
FIG. 2C is a schematic, cross-sectional, close-up view of a lamp disposed in a trough according to one embodiment.

FIG. 2C is a schematic, cross-sectional, close-up view of a lamp 102 disposed in a reflective trough 143 having a substantially parabolic shaped cross-section. As depicted, the reflective trough 143 has a parabolic shaped cross-section. The distance A, described with regard to FIG. 2B, may be a distance between the lamp 141 and the wall 204 of the reflective trough at a first region of the reflective trench 143. A distance B which may be different than the distance A may be the distance between the bulb 141 and a vertex of the parabola shaped trough along an axis of symmetry of the parabola shaped trough 143. For example, the distance B may be greater than the distance A or the distance B may be less than the distance A. In either example, the wall 204 of the parabola shaped reflective trough 143 may comprise a curvilinear surface or a plurality of linear surfaces forming a substantially parabola shaped reflective trough 143.

In some examples, the vertex of the parabola shaped reflective trough 143 may be truncated, for example, a portion of the wall 204 at the vertex region may be substantially linear along a horizontal plane and curvilinear portions of the wall 204 may extend from the truncated portion of the reflective trough 143. In other examples, sections of the parabola may curve away from the vertex region and may be replaced by linear line segments, alone or in addition to segments at the vertex. For the sake of simplicity, these elements may be included in the description of a "truncated parabola." Certain embodiments may include a linear and/or hollow light pipe in linear segments disposed within the reflective trough 143 where the light pipe may be coupled at the vertex of the parabola shaped reflective trough 143.

Similar to FIG. 2B, a portion of the lamp 102 may be disposed within the reflective trough 143. As depicted by the horizontal dashed line, approximately one half of the lamp 102 may be disposed within the reflective trough 143 and the remainder of the lamp 102 may remain outside the reflective trough 143. However, it is contemplated that more of less of the lamp 102 may be disposed within the reflective trough 143 to suit radiation requirements as the amount of lamp 102 disposed within the reflective trough 143 may alter the radiation characteristics of the lamp 102.

Figure 3A:
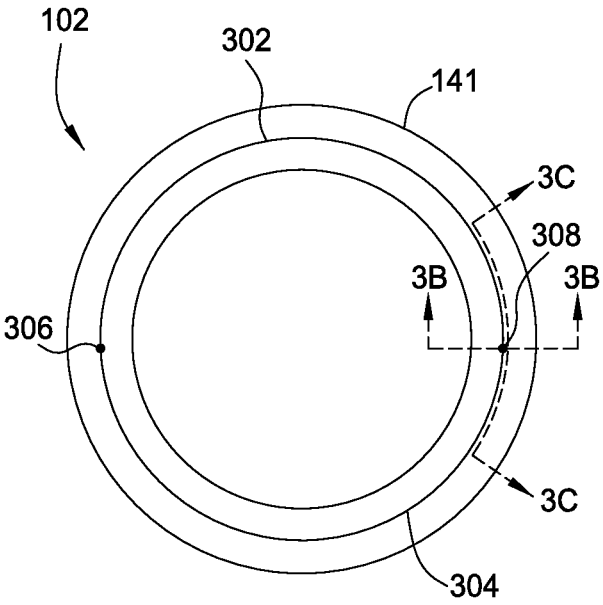
FIG. 3A is a plan view of a torroidal lamp according to one embodiment.

FIG. 3A is a plan view of a lamp 102. The lamp 102, for example, may be a curved linear lamp or torroidal lamp, and may comprise a substantially torus shaped bulb 141 and may have a hollow interior within which one or more filaments 302, 304 may be disposed. The lamp 102 may comprise a material suitable for emitting radiation therefrom, such as a quartz material. A first filament 302 may be coupled between a first coupling member 306 and a second coupling member 308. A second filament 304 may also be coupled between the first coupling member 306 and the second coupling member 308. The first filament 302 may be formed between the first coupling member 306 and the second coupling member 308. The second filament 304 may also be coupled between the first coupling member 306 and the second coupling member 308, however, the second filament 304 may occupy a region of the bulb 141 not occupied by the first filament 302. The first coupling member 306 may comprise a lead having a first polarity and the second coupling member 308 may comprise a lead having a second polarity opposite the first polarity, for example, a positive charge or a negative charge, respectively.

Figure 3B:
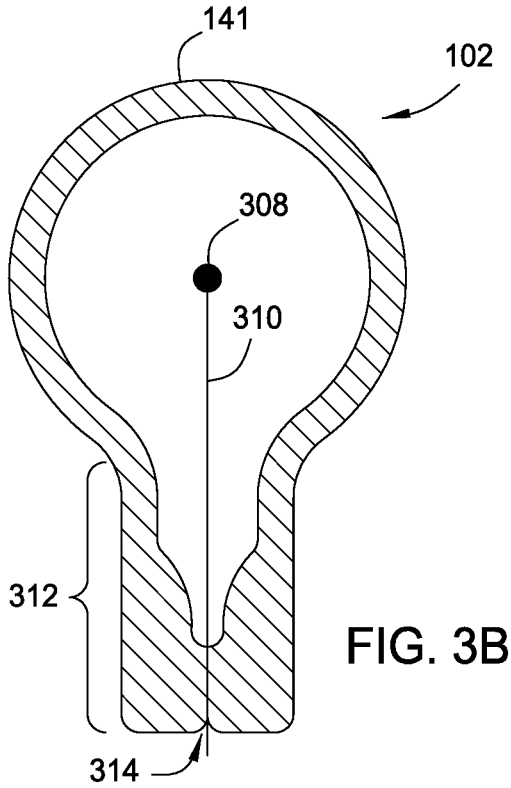
FIG. 3B is a cross-sectional view of the torroidal lamp of FIG. 3A taken along line A-A according to one embodiment.

FIG. 3B is a cross-sectional view of the lamp 102 of FIG. 3A taken along line 3B-3B. The bulb 141 may comprise the torroidal shaped portion substantially surrounding the second coupling member 308 and a seal 312. A lead 310 may extend from the second coupling member 308 through the seal 312 and beyond an exit region 314 where the lead may be coupled to a power source (not shown). The lead 310 may carry a positive or negative current depending upon the design of the circuitry of the lamp 102. Another lead (not shown) may extend from the first coupling member and may carry a current opposite the current carried by the lead 310. The seal 312 may be formed from an insulative material to ensure the current reaches the second coupling member 308 where the first and second filaments 302, 304 are electrically coupled to the second coupling member 308. An example of an insulative material for the seal may be a quartz material, among others.

Figure 3C:
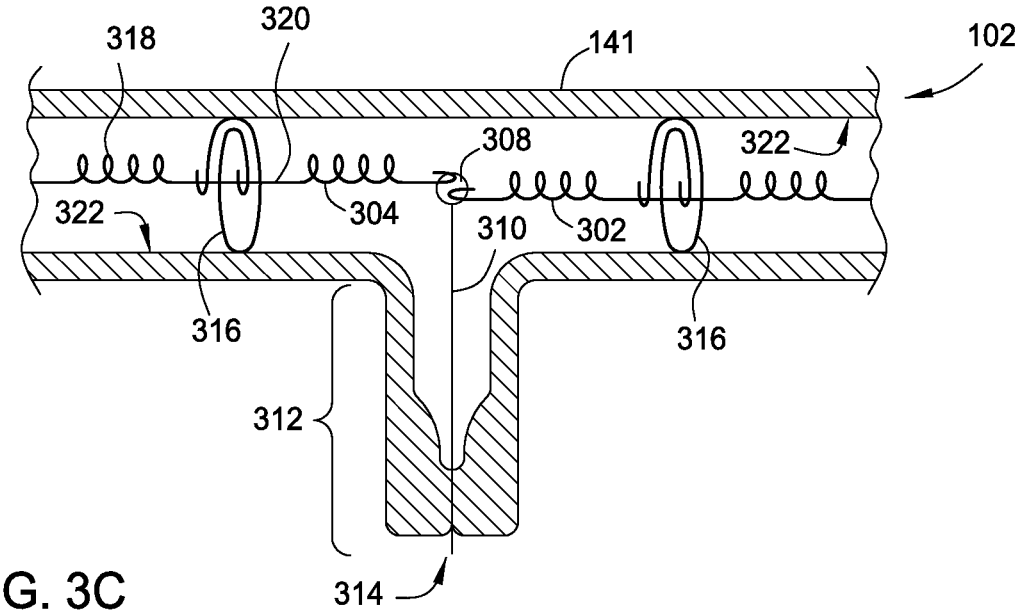
FIG. 3C is a cross-sectional view of the torroidal lamp of FIG. 3A taken along line B-B according to one embodiment.

FIG. 3C is a cross sectional view of the torroidal lamp 102 of FIG. 3A taken along line 3C-3C. The torroidal shaped portion of the lamp 102, for example, the bulb 141, may occupy a first plane and the seal 312 may occupy a plane angled from the plane of the bulb 141. In one example, the seal 312 may be in a plane perpendicular to the first plane, however, it is contemplated that the seal 312 may be angled at any suitable angle from the first plane of the torroidal shaped bulb 141 portion of the lamp 102.

As depicted, the first filament 302 and the second filament 304 may be coupled to the second coupling member 308. For example, the first and second filaments 302, 304, may comprise an electrically conductive material, such as a metallic wire, and may contact the second coupling member 308 to electrically couple the filaments 302, 304 to a power source (not shown) via the lead 310. For example, the filaments 302, 304 may hook through the second coupling member 308, which may be a wire ring or the like. The filaments 302, 304 may be formed into various shapes suitable for emitting radiation when an electrically current is applied to the filaments 302, 304. For example, the filaments 302, 304 may comprise coiled regions 318 and linear regions 320 arranged in a repeating pattern. The coiled regions 318 of the filaments 302, 304 may be spaced apart by the linear regions 320 by between about 1 cm and about 5 cm, such as between about 1.5 cm and about 3 cm. Support members 316 may be coupled to the filaments 302, 304 at the linear regions 320. For example, the support members 316 may contact the linear regions 320 and hold the filaments 302, 304 in a fixed position within the bulb 141. In another example, the support member 316 may be coupled with the filaments 302, 304 at the coiled regions 318. The support members may be sized to contact interior surfaces 322 of the bulb 141 which may help position the filaments 302, 304 properly within the bulb 141. In some embodiments, the bulb 141 may have an outer diameter of between about 5 mm and about 25 mm, such as about 11 mm.

Figure 3D:
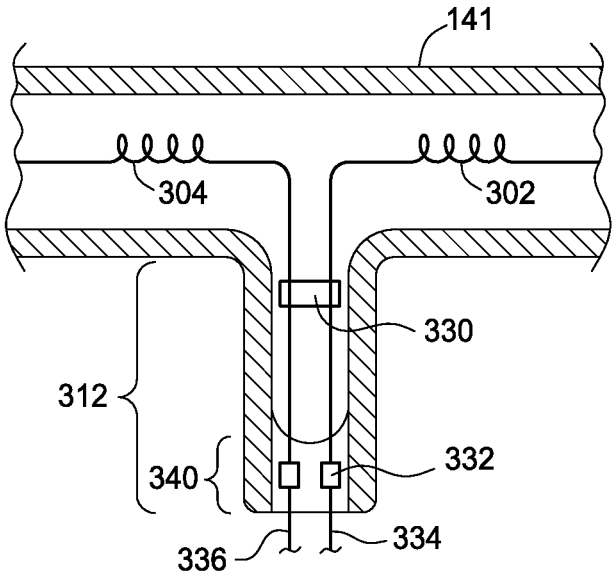
FIG. 3D is a schematic, cross-sectional view of the torroidal lamp of FIG. 3A taken along line 3C-3C according to one embodiment.

FIG. 3D is a schematic, cross sectional view of the torroidal lamp 102 of FIG. 3A taken along line 3C-3C according to one embodiment. The filaments 302, 304 may be spaced apart by a bridge member 330 which may physically separate the filaments to prevent shorting. The bridge member 330 may be disposed within the seal 312, which may comprise a hermetic seal 340. One or more foils 332 may be disposed within the hermetic seal 340 and may be coupled to the filaments 304, 302. For example each filament 302, 304 may be coupled with its own foil 332. A first power lead 334 and a second power lead 336 may be coupled to a single foil 332 and may be coupled to a power source.

Figure 4A:
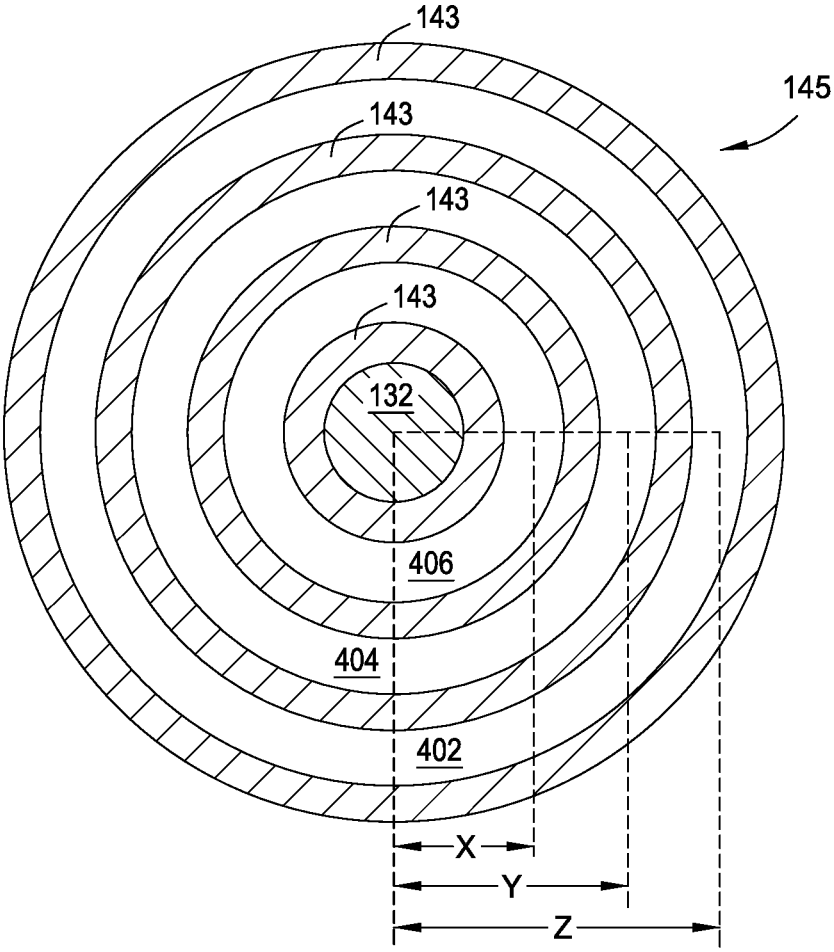
FIG. 4A is a schematic, plan view of a lamphead according to one embodiment.

FIG. 4A is a schematic, plan view of the lamphead 145 according to one example. The lamphead 145 may comprise a first torroidal lamp 406, a second torroidal lamp 404, a third torroidal lamp 402, and a plurality of reflective annular troughs 143 within which the first, second, and third torroidal lamps 406, 404, 402 may be disposed. The shaft 132 of the substrate support may be disposed through a center region of the lamphead 145. Although only three torroidal lamps 406, 404, 402 are depicted, a greater or lesser number of torroidal lamps and reflective annular troughs 143 may be utilized to achieve a desired lamphead design for irradiating a substrate. For example, several torroidal lamps may be located between the first torroidal lamp 406 and the second torroidal lamp 404 and several more torroidal lamps may be located between the second torroidal lamp 404 and the third torroidal lamp 402. As previously mentioned, as many as 7 or more torroidal lamps, such as about 13 torroidal lamps maybe utilized in the lamphead 145. As such, spacing between the torroidal lamps may be substantially equal or the spacing may not be constant between each lamp.

The first torroidal lamp 406 may have a radius X (measured from a center of the lamphead 145 to a center of the torroidal lamp which may be approximated by the filament within the bulb) which may be between about 50 mm and about 90 mm, such as about 72 mm. The second torroidal lamp 404 may have a radius Y which may be between about 110 mm and about 150 mm, such as about 131 mm. The third torroidal lamp 402 may have a radius Z which may be between about 170 mm and about 210 mm, such as about 190 mm. It is contemplated that the radii of the torroidal lamps may be reduced or enlarged for irradiating substrates having diameters of about 200 mm, 300 mm, or 450 mm.

Figure 4B:
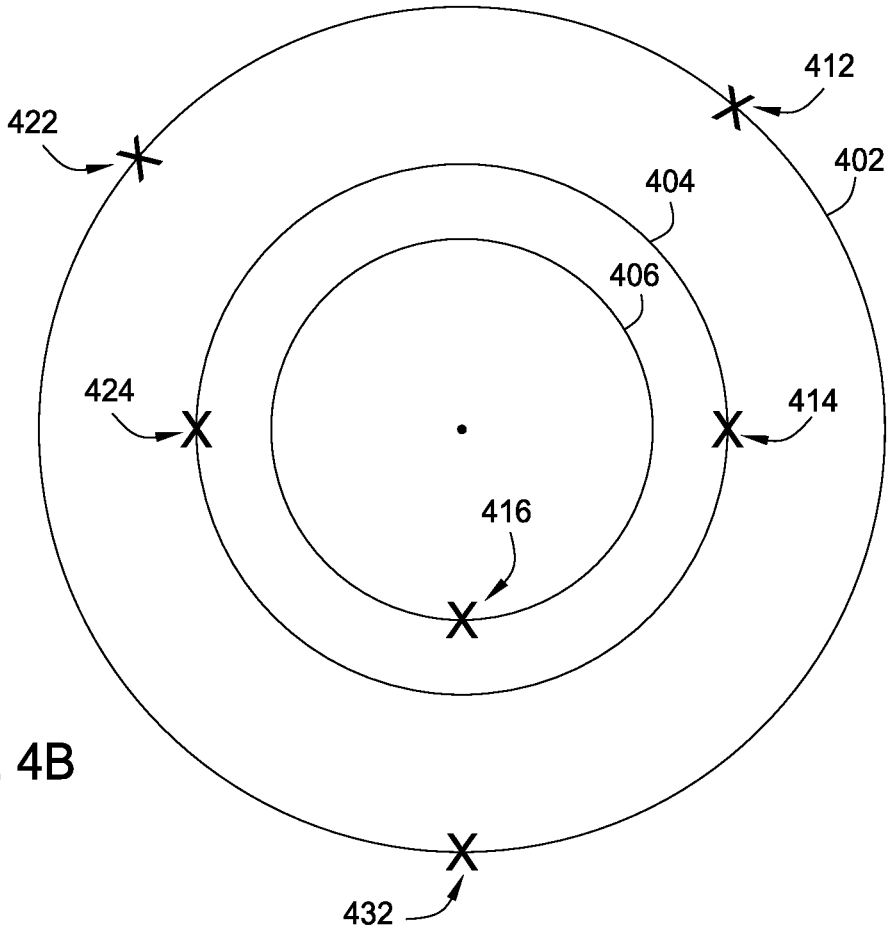
FIG. 4B is a schematic, plan view representative of a plurality of torroidal lamps arranged in a concentric pattern according to one embodiment.

FIG. 4B is a schematic, plan view representative of a plurality of torroidal lamps 406, 404, 402 arranged in a concentric pattern. The concentric pattern may comprise the first torroidal lamp 406 encircled by the second torroidal lamp 404. The second torroidal lamp 404 may be encircled by the third torroidal lamp 402. Radiation loss regions 412, 422, 432, 414, 424, 416 may be representative of regions on the torroidal lamps 406, 404, 402 where the seal (not shown) and coupling members (not shown) are present (See FIG. 3C for more detail). The amount of radiation radiating from the radiation loss regions 412, 422, 432, 414, 424, 416 may affect the uniformity with which a substrate is irradiated. Minimizing the potentially negative effects of the radiation loss regions 412, 422, 432, 414, 424, 416 may be achieved by the spatial arrangement of each radiation loss region in relation to nearby radiation loss regions.

For example, the first torroidal lamp 406 may have a first radiation loss region 416 corresponding to the seal 312. The length of filament which may be energized within the first torroidal lamp 406 may be approximately equal to the circumference of the first torroidal lamp 406. The second torroidal lamp 404 may have second radiation loss regions 414, 424 which may correspond to two seals, respectively. The second radiation loss regions 414, 424 may be disposed at positions antipodal to one another such that a length of the filament between the second radiation loss regions 414, 424, may be approximately equal to the length of the filament within the first torroidal lamp 406. The third torroidal lamp 402 may have third radiation loss regions 412, 422, 432 which may correspond to three seals, respectively. In this example, the polarities at each seal 312 may correspond to the three phases in a 3-phase alternative current supply. The third radiation loss regions 412, 422, 432 and associated seals, may be disposed substantially equidistant from one another along the third torroidal lamp 402 such that a length of the filament between the third radiation loss regions 412, 422, 432 may be approximately equal to the length of the filament within the first torroidal lamp 406 and the length of the two filament segments in the second torroidal lamp 404.

Placing the seals at locations along the torroidal lamps 406, 404, 402 to increase the distance between the resulting radiation loss regions 412, 422, 432, 414, 424, 416 may ultimately reduce or mask the effect of the radiation loss regions 412, 422, 432, 414, 424, 416. Moreover, by approximately equalizing the filament segment lengths, a single controller may be utilized to provide power to the filaments to reduce to complexity of the associated circuitry and reduce the necessity for numerous power sources providing different voltages for individual filament segments. In certain embodiments, each filament segment may be individually controlled. The filament segments may be wire in parallel if an even number of segments per lamp is utilized. If an odd number of segments per lamp is utilized, then a number of phases equal to the number of segments may equal a multiple of the number of phases.

In one example, the first torroidal lamp 406 may have a radius of about 72 mm and the filament segment length may be about 450 mm. The second torroidal lamp 404 may have a radius of about 131 mm and the length of each of the two filament segments may be about 410 mm. The third torroidal lamp 402 may have a radius of about 190 mm and the length of each of the three filament segments may be about 400 mm.

Figure 5A:
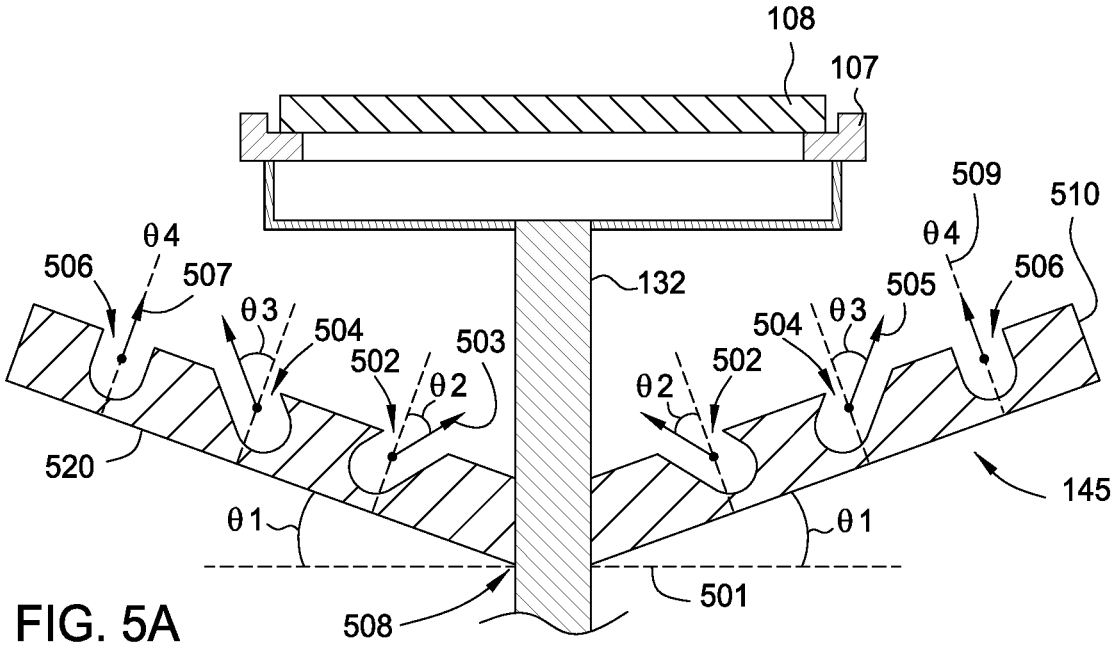
FIG. 5A is a cross-sectional view of a lamphead and a substrate support according to one embodiment.

FIG. 5A is a cross-sectional view of the lamphead 145 and the substrate support 107 according to one embodiment. The lamphead 145 may comprise a conical shape and may be angled a first angle 81 from a horizontal plane 501 between about 5° and about 25°, such as about 22°. A first annular trough 502 may be formed in the lamphead 145 such that a focal axis 503 of the first annular trough 502 may angle toward a center region 508 of the lamphead 145. For example, the focal axis 503 of the first annular trough 502 may be positioned at a second angle 82 of between about 5° and about 25° from a line 509 normal to a plane defined by a lower surface 520 of the lamphead 145. A second annular trough 504 may be formed in the lamphead 145 encircling the first annular trough 502. The second annular trough 504 may have a focal axis 505 that is angled toward an outer edge 510 of the lamphead 145. For example, the focal axis 505 of the second annular trough 504 may be positioned at a third angle 83 of between about 5° and about 25° from the line 509 normal to the plane defined by the lower surface 520 of the lamphead 145. A third annular trough 506 may also be formed in the lamphead 145 and may encircle the second annular trough 504. The third annular trough 506 may have a focal axis 507 that is substantially parallel to the line 509 normal to the plane defined by the lower surface 520 of the lamphead 145. As a result, a fourth angle 84 may be about 0°

Figure 5B:
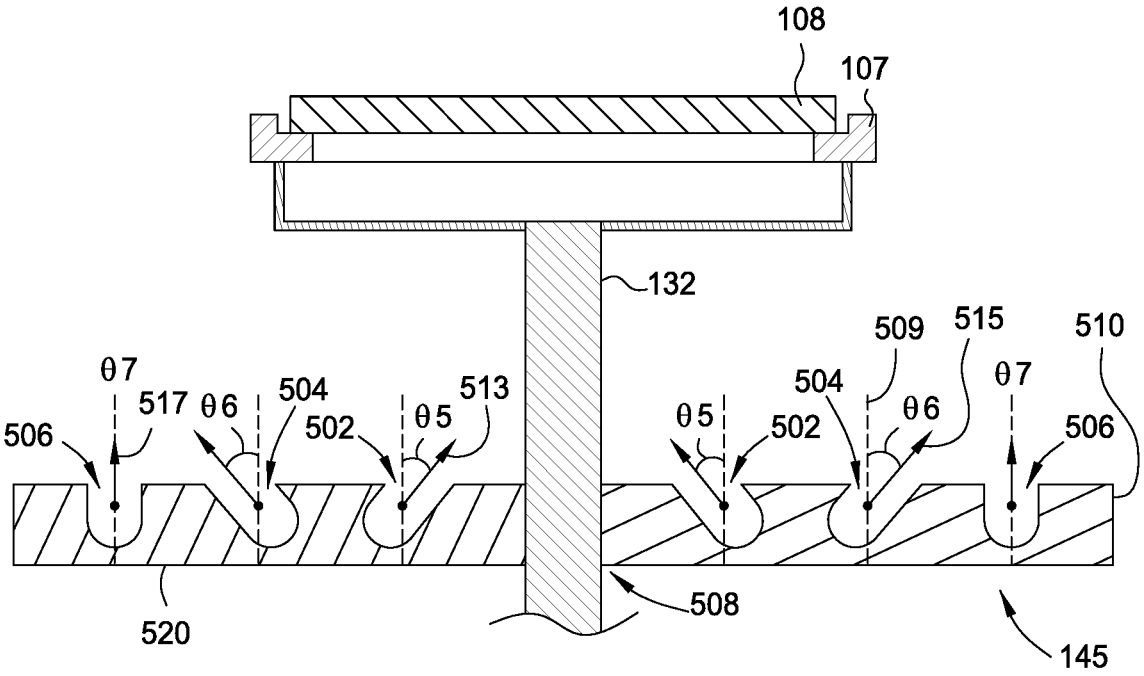
FIG. 5B is a cross-sectional view of a lamphead and a substrate support according to one embodiment.

FIG. 5B is a cross-sectional view of the lamphead 145 and the substrate support 107 according to one embodiment. The lamphead 145 is similar to the lamphead 145 of FIG. 5A except that the lamphead 145 of FIG. 5B is flat instead of conical. A focal axis 513 of the first annular trough 502 may angle toward the center region 508 of the lamphead 145. For example, the focal axis 513 of the first annular trough 502 may be positioned at a fifth angle 85 of between about 5° and about 25° from the line 509 normal to a horizontal plane occupied by the lower surface 520 of the lamphead 145. The second annular trough 504 may have a focal axis 515 that is angled toward an outer edge 510 of the lamphead 145. For example, the focal axis 515 of the second annular trough 504 may be positioned at a sixth angle 86 of between about 5° and about 25° from the line 509 normal to the horizontal plane occupied by lower surface 520 of the lamphead 145. The third annular trough 506 may have a focal axis 517 that is substantially parallel to the line 509 normal to the horizontal plane occupied by the lower surface 520 of the lamphead 145. As a result, a seventh angle 87 may be about 0°.

The annular troughs 502, 504, 506 are representative of three troughs within which a lamp may be disposed. The lamp disposed within each of the annular troughs 502, 504, 506 may be a single torroidal lamp or a plurality of bulbs having a right circular cylindrical coil disposed therein. The lamps may generally radiate toward a substrate at an angle of the focal axis of the trough. A greater or lesser number of troughs may be incorporated into the lamphead, and various combinations of angled troughs may function to achieve a substantially uniform irradiance across the entire surface of a substrate.

Figure 6:
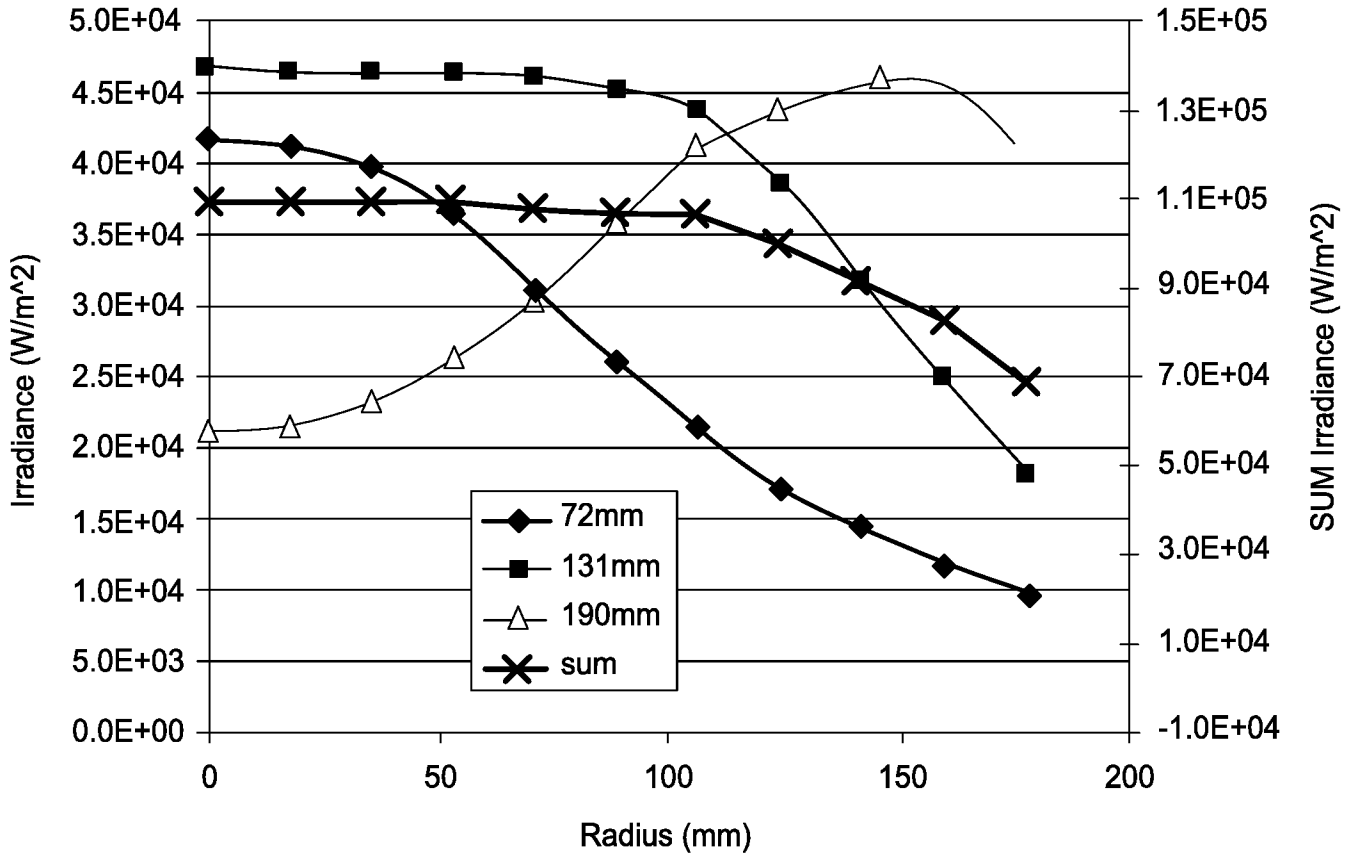
FIG. 6 is a graph depicting the amount of irradiance for a lamphead according to one embodiment.

FIG. 6 is a graph depicting the amount of irradiance for a lamphead according to one embodiment. The model calculations of the graph were made utilizing a lamphead with a first trough having a radius of about 72 mm, a second trough having a radius of about 131 mm, and a third trough having a radius of about 190 mm. The three troughs were angled according to the embodiments described with regard to Figured 5A-5B. Although the individual troughs provided a wide range of irradiance, the sum irradiance over the surface of the substrate was much more constrained, that is, a much more even amount of irradiance. For example, it can be seen that the sum irradiance across the surface of the substrate only ranged from about 7.0 $E^4$ to about 1.1 $E^5$. Thus, the combination of angled troughs may provide an improved sum irradiance which may provide a relatively equal amount of thermal energy across the surface of the substrate.

Figure 7A:
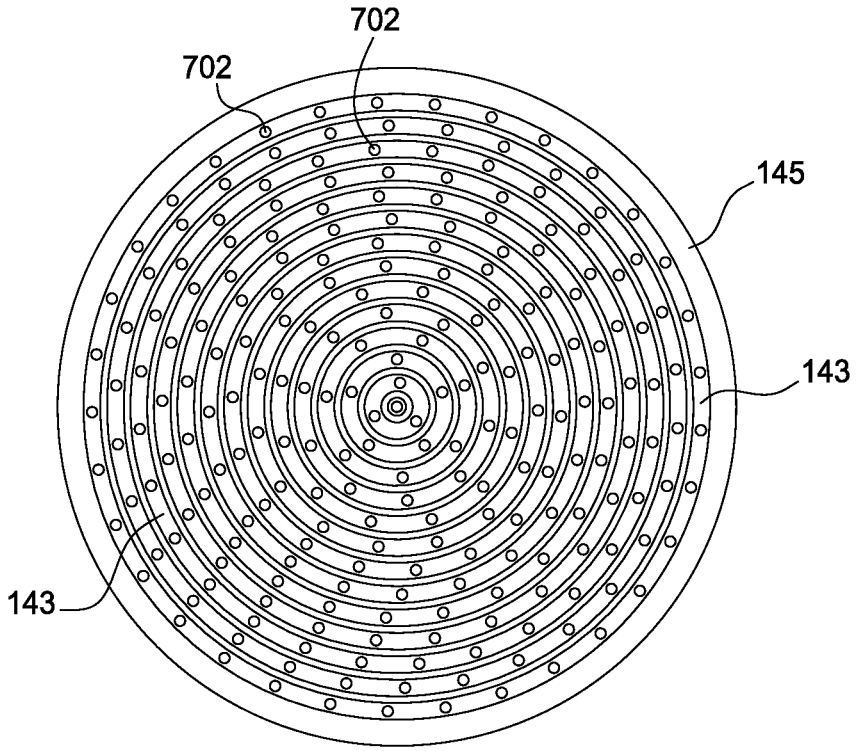
FIG. 7A is a plan view of a lamphead according to one embodiment.

FIG. 7A is a plan view of a lamphead 145 according to one embodiment. As opposed to previously described embodiments utilizing a torroidal shaped lamp, a plurality of bulbs 702 having a right circular cylindrical coil disposed therein may be disposed within the reflective troughs 143 of the lamphead 145. Similar to previously described embodiment, the reflective troughs 143 may be semi-circular cross-sectional shaped, or parabola or truncated parabola cross-sectional shaped. The number of bulbs 702 disposed in the lamphead 145 may be between about 100 and about 500 bulbs, such as about 164 bulbs, or 218 bulbs, or 334 bulbs.

Figure 7B:
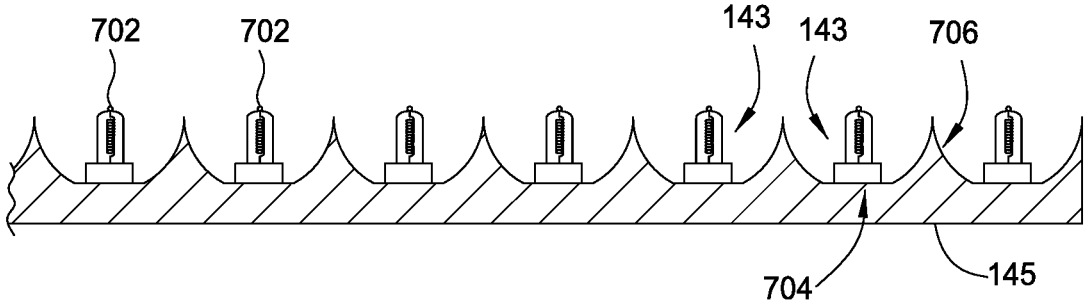
FIG. 7B is a cross-sectional view of a portion of the lamphead of FIG. 7A according to one embodiment.

FIG. 7B is a cross-sectional view of a portion of the lamphead 145 of FIG. 7A. For clarity, the bulbs 702 having a right circular cylindrical coil disposed therein may be disposed within the reflective troughs 143. In the example shown, the reflective troughs 143 may have a truncated parabolic cross-section such that the vertex region 704 of the parabolic shape is substantially linear instead of curvilinear. In some embodiments, the bulbs 702 may be coupled to the reflective troughs 143 having truncated parabolic cross-sections at the linear section of the vertex region 704.

While the foregoing is directed to embodiments of the present disclosure, other and further embodiments of the disclosure may be devised without departing from the basic scope thereof, and the scope thereof is determined by the claims that follow.

The invention claimed is:

1. A lamphead apparatus, comprising:

a body having a bottom surface defining a plane;

a plurality of reflective troughs defined in the body; and at least one reflective trough of the plurality of reflective troughs has a wall formed in the body, wherein a focal axis of the at least one reflective trough is angled away from a center of the body at an angle relative to an axis normal to the plane defined by the bottom surface, wherein the focal axis and the axis normal to the plane converge at a center of the at least one reflective trough, and a radial distance from the center of the at least one reflective trough to the wall varies over an entirety of the wall.

2. The lamphead apparatus of claim 1, wherein the bottom surface of the body is flat with respect to a horizontal plane extending substantially parallel to the bottom surface.

3. The lamphead apparatus of claim 1, wherein the bottom surface of the body is conical with respect to a horizontal plane extending substantially parallel to the bottom surface.

4. The lamphead apparatus of claim 1, wherein the at least one reflective trough has a semi-circular cross-section, parabolic cross-section, truncated parabolic cross-section, or a combination thereof.

5. The lamphead apparatus of claim 1, wherein the angle of the at least one reflective trough is between about 5° and about 25° from the axis normal to the plane defined by the bottom surface of the body.

6. The lamphead apparatus of claim 1, wherein the at least one reflective trough has a radius of between about 50 mm and about 90 mm.

7. The lamphead apparatus of claim 1, wherein a curved linear lamp is disposed at least partially within the at least one reflective trough at an angle which is similar to the focal axis of the at least one reflective trough.

8. A lamphead apparatus, comprising:

a body having a bottom surface defining a plane;

a plurality of reflective troughs defined in the body;

a first reflective trough of the plurality of reflective troughs having a first wall formed in the body, the first reflective trough having a first focal axis positioned at a first angle relative to an axis normal to the plane defined by the bottom surface, the first reflective trough angled toward a center of the body, wherein the first focal axis and the axis normal to the plane converge at a first center, and a first radial distance from the first center to the first wall varies over an entirety of the first wall; and a second reflective trough of the plurality of reflective troughs having a second wall formed in the body and surrounding the first reflective trough, the second reflective trough having a second focal axis positioned at a second angle relative to the axis normal to the plane defined by the bottom surface, the second reflective trough angled away from the center of the body, wherein the second focal axis and the axis normal to the plane converge at a second center, and a second radial distance from the second center to the second wall varies over an entirety of the second wall.

9. The lamphead apparatus of claim 8, wherein the body is flat or conical.

10. The lamphead apparatus of claim 8, wherein the first angle is between about 5° and about 25° from the axis normal to the plane defined by the bottom surface of the body.

11. The lamphead apparatus of claim 10, wherein the second angle is between about 5° and about 25° from the axis normal to the plane defined by the bottom surface of the body.

12. The lamphead apparatus of claim 8, wherein the first reflective trough has a radius of between about 50 mm and about 90 mm.

13. The lamphead apparatus of claim 12, wherein the second reflective trough has a radius of between about 110 mm and about 150 mm.

14. A lamphead apparatus, comprising:

a body having a bottom surface defining a plane;

a plurality of reflective troughs defined in the body;

a first reflective trough of the plurality of reflective troughs having a first wall formed in the body, the first reflective trough having a first focal axis positioned at a first angle relative to an axis normal to the plane defined by the bottom surface, the first reflective trough angled toward a center of the body, wherein the first focal axis and the axis normal to the plane converge at a first center, and a first radial distance from the first center to the first wall varies over an entirety of the first wall;

a second reflective trough of the plurality of reflective troughs having a second wall formed in the body and adjacent to the first reflective trough, the second reflective trough having a second focal axis positioned at a second angle relative to the axis normal to the plane defined by the bottom surface different than the first angle, the second reflective trough angled away from the center of the body, wherein the second focal axis and the axis normal to the plane converge at a second center, and a second radial distance from the second center to the second wall varies over an entirety of the second wall; and a third reflective trough of the plurality of reflective troughs having a third wall formed in the body and surrounding the first reflective trough and the second reflective trough, the third reflective trough having a third focal axis positioned at a third angle relative to the axis normal to the plane defined by the bottom surface, the third angle different than the first angle and the second angle.

15. The lamphead apparatus of claim 14, wherein the first angle is between about 5° and about 25° from the axis normal to the plane defined by the bottom surface of the body.

16. The lamphead apparatus of claim 15, wherein the second angle is between about 5° and about 25° from the axis normal to the plane defined by the bottom surface of the body.

17. The lamphead apparatus of claim 16, wherein the third focal axis of the third reflective trough is parallel to the axis normal to the plane defined by the bottom surface of the body.

18. The lamphead apparatus of claim 14, wherein the first reflective trough has a radius of about 72 mm, the second reflective trough has a radius of about 131 mm, and the third reflective trough has a radius of about 190 mm.

19. The lamphead apparatus of claim 14, wherein a single torroidal lamp or a plurality of bulbs are disposed within each of the first reflective trough, the second reflective trough and the third reflective trough.

20. The lamphead apparatus of claim 14, wherein the first reflective trough, the second reflective trough, and the third reflective trough further comprise between about 7 and about 13 reflective troughs.

* * * * *